US010101026B2

(12) United States Patent
Brehmer et al.

(10) Patent No.: US 10,101,026 B2
(45) Date of Patent: Oct. 16, 2018

(54) EVAPORATOR ARRANGEMENT

(75) Inventors: Martin Brehmer, Woggersin (DE); Steffen Weber, Neubrandenburg (DE); Matthlas Pfau, Neubrandenburg (DE); Edgar Miesterfeldt, Neubrandenburg (DE)

(73) Assignee: WEBASTO SE, Stockdorf (DE)

( * ) Notice: Subject to any disclaimer, the term of this patent is extended or adjusted under 35 U.S.C. 154(b) by 1248 days.

(21) Appl. No.: 14/113,753

(22) PCT Filed: May 11, 2012

(86) PCT No.: PCT/DE2012/100137

§ 371 (c)(1),
(2), (4) Date: May 6, 2014

(87) PCT Pub. No.: WO2012/155897

PCT Pub. Date: Nov. 22, 2012

(65) Prior Publication Data

US 2014/0234792 A1 Aug. 21, 2014

(30) Foreign Application Priority Data

May 15, 2011 (DE) ..... 10 2011 050 368

(51) Int. Cl.
*F23D 14/14* (2006.01)
*F23D 3/40* (2006.01)
*F23D 5/10* (2006.01)

(52) U.S. Cl.
CPC ..... *F23D 3/40* (2013.01); *F23D 5/10* (2013.01); *F23D 2900/05002* (2013.01); *F23D 2900/21002* (2013.01)

(58) Field of Classification Search
CPC ..... F23D 3/40
USPC ..... 431/319, 320, 326, 328, 329, 335; 126/92 AC, 95
See application file for complete search history.

(56) References Cited

U.S. PATENT DOCUMENTS 4,597,734 A * 7/1986 McCausland ..... B22F 3/002 126/92 AC
4,810,587 A * 3/1989 Losfeld ..... B22F 3/002 428/549
5,218,952 A * 6/1993 Neufeldt ..... E01C 23/14 126/92 AC
5,605,453 A 2/1997 Kenner et al.
(Continued)

FOREIGN PATENT DOCUMENTS

CN 11 25 478 A 6/1996
CN 14 99 132 A 5/2004
(Continued)

OTHER PUBLICATIONS

International Search Report dated Nov. 8, 2012, issued in International Application PCT/DE2012/100137.

*Primary Examiner* — Vivek Shirsat
(74) *Attorney, Agent, or Firm* — Fitch, Even, Tabin & Flannery, LLP

(57) ABSTRACT

An evaporator arrangement for an evaporator burner for a mobile heating device is provided, having: an evaporator body support into which a fuel supply line for supplying a liquid fuel opens, and an evaporator body for distributing and evaporating the liquid fuel. The evaporator body comprises at least one layer of a metal woven fabric of interwoven metal wires.

15 Claims, 1 Drawing Sheet

(56) References Cited

U.S. PATENT DOCUMENTS 5,749,721 A * 5/1998 Klinge ..... F23D 14/16
431/328
6,045,355 A * 4/2000 Chapman ..... F23D 14/14
431/326

FOREIGN PATENT DOCUMENTS

| | | | |
|---|---|---|---|
| DE | 39 14611 | A1 | 12/1989 |
| DE | 44 01 799 | C1 | 6/1995 |
| DE | 102 17 675 | A1 | 11/2003 |
| DE | 10 2004 020 129 | B3 | 8/2005 |
| DE | 10 2005 001 900 | A1 | 7/2006 |
| DE | 10 2005 020 147 | A1 | 11/2006 |
| DE | 10 2007 012 512 | A1 | 9/2008 |
| DE | 10 2007 019 360 | A1 | 10/2008 |
| DE | 10 2008 031 083 | A1 | 1/2010 |
| EP | 1 970 624 | A2 | 9/2008 |
| EP | 1 978 302 | A2 | 10/2008 |
| RU | 2 310 128 | C1 | 5/1999 |
| SU | 2196 | A1 | 1/1927 |

* cited by examiner

EVAPORATOR ARRANGEMENT

CROSS-REFERENCE TO RELATED APPLICATIONS

This application is a U.S. National Stage filing under 35 U.S.C. 371 of International Application No. PCT/DE2012/100137, filed May 11, 2012, designating the United States and claims the benefit of foreign priority from German Patent Application No. 10 2011 050 368.4, filed May 15, 2011, the entire disclosures of which are incorporated herein by reference.

The present invention relates to an evaporator arrangement for an evaporator burner for a mobile heating device and to a mobile heating device.

Mobile heating devices are known which can e.g. be employed as vehicle heating devices for heating of a vehicle. In applications in a vehicle, such mobile heating devices are e.g. employed as supplementary heaters capable of providing additional heat when the propulsion engine of the vehicle is running or as parking heaters capable of providing heat for heating purposes both when the propulsion engine is running and when the propulsion engine is turned off.

In mobile heating devices comprising an evaporator burner, liquid fuel which can e.g. correspond to the fuel which is also used for a combustion engine of the vehicle, such as benzine, diesel or ethanol, is fed to an evaporator body consisting of a porous, absorbent material via a fuel supply line. The fuel is evaporated at the evaporator body. The fuel is mixed with combustion air which is also supplied and converted in an exothermal reaction thereby generating heat. The resulting hot exhaust gases are typically routed through a heat exchanger in which at least a part of the generated heat is transferred to a medium to be heated which can e.g. be formed by air or by a liquid, in particular cooling liquid in a cooling liquid circuit of a combustion engine.

In such evaporator burners, the fuel is typically supplied to the evaporator body support holding the evaporator body via a fuel supply line. In this arrangement, the evaporator body substantially fulfills two functions: on the one hand, an as much as possible uniform distribution of the fuel over the evaporator body shall be provided and, on the other hand, the fuel shall be evaporated as uniformly and efficiently as possible. Since the flame is formed in immediate proximity to the evaporator body during operation in such evaporator burners, the evaporator body must further comprise high temperature stability.

It is an object of the present invention to provide an improved evaporator arrangement for an evaporator burner for a mobile heating device.

The object is solved by an evaporator arrangement for an evaporator burner for a mobile heating device according to claim 1. Advantageous further developments are defined in the dependent claims.

The evaporator arrangement comprises: an evaporator body support into which a fuel supply line for supplying a liquid fuel opens, and an evaporator body for distributing and evaporating the liquid fuel. The evaporator body comprises at least one layer of a metal woven fabric of interwoven metal wires. A metal woven fabric is understood as an arrangement resulting from weaving of weft threads and warp threads, wherein both the weft threads and the warp threads are formed by metal wires. Preferably, the utilized metal wires all comprise the same wire diameter and the wire diameter is also constant over the length of the metal wires. Preferably, the metal wires are formed to be round wires having a circular cross-sectional shape. The metal woven fabric is preferably woven uniformly in a regular pattern, wherein different known weaving patterns can be adopted, such as plain weaving, twill weaving, etc.

By providing the at least one layer of a metal woven fabric of interwoven metal wires, the evaporator body can be provided with exactly defined characteristics since the position of the metal wires relative to each other is precisely defined by the weaving procedure. Further, the metal wires interwoven to the metal woven fabric can be produced with high accuracy and process reliability such that discontinuities in the material of the evaporator body can be reliably avoided. Compared to an evaporator body of e.g. a metal non-woven fabric comprising a multitude of different fibers in an irregular arrangement, a substantially more uniform distribution of the fuel can be achieved in the layer of the metal woven fabric. Due to the regular arrangement of the metal wires, the capillary forces effecting or supporting the fuel distribution act well-defined and uniform. In this way, an overall more stable and reliable combustion behavior of the evaporator burner can be provided. The characteristics of the at least one layer of the metal woven fabric can be exactly predetermined by the selection of the wire diameter, the surface roughness of the wire, the weaving pattern and the distance of the well threads and warp threads relative to each other. At least one layer of a metal woven fabric is to be understood that also a plurality of layers of metal woven fabric having identical or different characteristics and having identical or different orientations can be utilized. Further, additionally to the at least one layer of a metal woven fabric, also other layers of e.g. metal wadding or preferably a metal non-woven fabric (i.e. metal fleece) can be utilized.

According to one development, the metal wires comprise stainless steel. The metal wires can in particular be made from stainless steel, in particular from a high-temperature resistant stainless steel. In this case, reliable characteristics of the evaporator body can be maintained also over a long operation time of the evaporator burner.

If the metal wires in the at least one layer comprise a constant wire diameter, uniform fuel distribution in the evaporator body can be achieved particularly reliably. In this context, "constant wire diameter" relates to both that the distinct metal wires comprise the mutually identical diameter and that the metal wires each comprise a constant diameter over their lengthwise extension.

According to one development, the metal wires comprise a wire diameter between 25 μm and 0.9 mm, preferably between 25 μm and 200 μm, even more preferably between 50 μm and 150 μm. It has been found that in particular these wire diameters lead to particularly advantageous acting capillary forces and to a uniform fuel distribution. In a realization with a plurality of layers in which the evaporator body comprises a plurality of layers of metal woven fabric, it is particularly advantageous if layers which are arranged closer to the opening of the fuel supply line have a larger wire diameter, e.g. between 100 μm and 0.9 mm, and layers which are arranged farther away from the opening of the fuel supply line have a smaller wire diameter, in particular between 25 μm and 200 μm, preferably between 50 μm and 150 μm.

According to one development, the metal wires in the metal woven fabric are tightly interwoven with a relation w/d of the mesh width w to the wire diameter d $w/d \leq 1$. This relation holds for the two weaving directions, i.e. in the direction of the weft threads and in the direction of the warp threads. Preferably, the weft threads and the warp threads comprise the identical wire diameter and the mesh width is at least substantially identical in the two weaving directions.

In particular with the indicated tight weaving, the fuel distribution in the evaporator body can be adjusted particularly well. Preferably, all layers of the evaporator body which are formed as metal woven fabric are formed tightly interwoven in this manner so that they are suitable for fuel transport and contribute to it.

According to one development, the evaporator body comprises a construction with plural layers with at least one layer of a metal non-woven fabric. In this case, both the positive effects of the metal woven fabric and the positive effects of the metal non-woven fabric can be exploited. Also in this development, plural layers of metal non-woven fabric and plural layers of metal woven fabric can be used. In particular, different layers of metal woven fabric can be used which differ in the wire diameter and/or in the mesh width. Preferably, the at least one layer of the metal non-woven fabric is arranged at a side of the layer of metal woven fabric facing away from the fuel supply line, i.e. the metal woven fabric is arranged towards the fuel supply line and the metal non-woven fabric is arranged towards the flame. In this case, particularly uniform distribution of the fuel over the entire cross-section of the evaporator body is achieved by the metal woven fabric and the thus distributed fuel can be efficiently evaporated in the metal non-woven fabric arranged behind it. The plural layers of the construction with plural layers can be interconnected by e.g. sintering or welding. In particular when plural, different layers of metal woven fabric are provided, the at least one layer of metal non-woven fabric can be arranged at a side of the layers of metal woven fabric which faces away from the fuel supply line or the at least one layer of metal non-woven fabric can also be arranged between layers of metal woven fabric.

According to one development, the evaporator body comprises a plural-layer construction with a plurality of layers of metal woven fabric of interwoven metal wires. In this case, the fuel distribution can be adjusted particularly exactly. For example, plural layers of the same metal woven fabric can be used wherein in particular the orientation of the metal woven fabric (the direction of the weft threads and the warp threads in one layer in relation to the direction of the weft threads and the warp threads in a further layer) can be varied in order to achieve particularly uniform fuel distribution. However, on the other hand, also plural layers of different metal woven fabrics can be used, e.g. having different wire diameters, different mesh widths, different weaving patterns, different roughness of the wires, etc. Preferably, at least one first layer of metal woven fabric and a second layer of metal woven fabric are provided, the second layer being arranged at a side of the first layer facing away from the fuel supply line, and the second layer is formed from metal wires having a smaller wire diameter than the metal wires in the first layer. In this way, first a rough fuel distribution can take place in the layer having large fuel channels which is arranged closer to the fuel supply line and a very uniform fine distribution in the subsequent second layer having finer wires and thus smaller fuel channels. The distinct layers can be interconnected e.g. by sintering or welding also in this arrangement.

According to one development, the evaporator body comprises a first region for distributing the liquid fuel and a second region for evaporating the liquid fuel, the second region having a structure differing from the structure in the first region. Due to this construction with plural layers having the first region and the second region, both an as much as possible optimized distribution of the fuel (at the side arranged more proximate to a fuel supply line) and an optimized evaporation (at the side facing a combustion space) can take place in the evaporator body. The second region can in particular comprise a structure with finer channels for the fuel as compared to the first region. For example, the first region can be formed by a metal woven fabric or by plural layers of metal woven fabric and the second region can be formed by one layer or plural layers of metal non-woven fabric or by one layer or plural layers of metal woven fabric having a smaller wire diameter.

According to one further development, at least one first layer of metal woven fabric, at least one second layer of metal woven fabric, the second layer being arranged at a side of the first layer facing away from the fuel supply line, and at least one layer of a metal non-woven fabric are provided and the at least one second layer is formed from metal wires having another wire thickness and/or another mesh width than the metal wires in the at least one first layer. In particular in such a construction with plural layers in which plural different layers of metal woven fabric and at least one layer of metal non-woven fabric are provided, both fuel evaporation and fuel distribution can be adjusted very selectively. The at least one layer of metal non-woven fabric can e.g. also be arranged between different layers of metal woven fabric.

According to one further development, the layer of metal non-woven fabric is arranged at a side of the at least one second layer of metal woven fabric facing away from the fuel supply line. The layer of metal non-woven fabric can preferably be directly adjacent to the second layer of metal woven fabric and can be fixedly connected to the second layer of metal woven fabric, e.g. by sintering.

According to one further development, the layer of metal non-woven fabric is arranged between the at least one first layer of metal woven fabric and the at least one second layer of metal woven fabric. The layer of metal non-woven fabric can preferably be directly adjacent to the second layer of metal woven fabric and can in particular be fixedly connected to the second layer of metal woven fabric, e.g. by sintering. If thus in this manner the at least one second layer of metal woven fabric is arranged at a side of the layer of metal non-woven fabric facing the combustion chamber, the at least one second layer of metal woven fabric can advantageously stabilize the evaporator body. Further, the uniform second layer of metal woven fabric can homogenize the heat input into the metal non-woven fabric and distribute it over the entire metal non-woven fabric.

According to a further development, the at least one second layer of metal woven fabric is formed from metal wires comprising a larger wire diameter and/or a larger mesh width than the metal wires in the at least one first layer. In particular in this case, the at least one first layer of metal woven fabric can be optimized with respect to a preferable fuel conveyance and fuel distribution and the at least one second layer of metal woven fabric can be optimized with respect to a stabilizing effect.

According to a further development, at least one layer of a metal non-woven fabric is provided which comprises a sintered metal non-woven fabric having a mean fiber length of the metal fibers shorter than 3 mm, preferably shorter than 2 mm, in particular shorter than 1.5 mm. It has been found that in particular with such a short fiber non-woven fabric (short fiber fleece) the distinct fibers of which are sintered to each other both excellent evaporation and good resistance can be achieved.

The object is also solved by a mobile heating device. In the present context, the term "mobile heating device" is to be understood as a heating device which is designed and correspondingly adapted for use in mobile applications. This means in particular that it is transportable (as the case may be, fixedly mounted in a vehicle or only placed therein for transport) and not exclusively adapted for permanent stationary use, as would be the case for heating of a building. The mobile heating device can be fixedly installed in a vehicle (land vehicle, boat, etc.), in particular in a land vehicle. In particular, it can be adapted for heating a vehicle interior, such as of a land vehicle, a water vehicle or an air plane, and a partly open room as can be found in boats, in particular yachts. The mobile heating device can also temporarily be used stationary, such as e.g. in big tents, containers (e.g. containers for building sites), and the like. According to a preferred further development, the mobile heating device is adapted as a parking heater or a supplementary heater for a land vehicle, such as e.g. a mobile home, a recreational vehicle, a bus, a passenger car, etc.

Further advantages and developments will become apparent from the following description of an embodiment with reference to the drawings.

FIG. 1 schematically shows an evaporator arrangement in an evaporator burner for a mobile heating device.

In the following, an embodiment is described with reference to FIG. 1 and FIG. 2.

Figure 1:
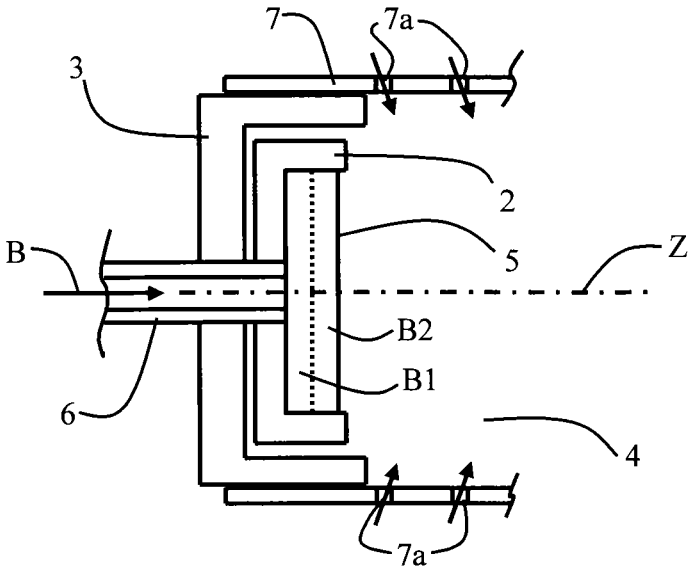
Figure 2:
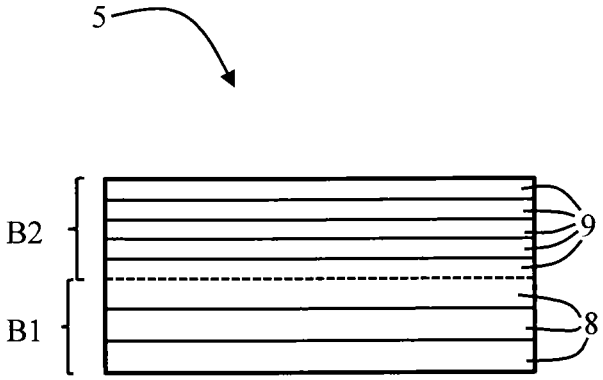
FIG. 2 is a schematic illustration of the evaporator body.

In FIG. 1, a region of an evaporator body support 2 and of a burner cap 3 of an evaporator burner for a mobile heating device is schematically illustrated. FIG. 1 is a schematic illustration in a plane containing a main axis Z of the evaporator burner. The evaporator burner can e.g. comprise substantially rotational symmetry with regard to the main axis Z. The evaporator burner can e.g. be formed for a vehicle heating device, in particular for a supplementary heater or for a parking heater. The evaporator burner is in particular formed to convert a mixture of evaporated fuel and combustion air in a combustion space 4 thereby generating heat. The heat which is set free is transferred to a medium to be heated, which can e.g. be formed by air or by a cooling liquid, in a heat exchanger (not shown). In the schematic illustration of FIG. 1, in particular the heat exchanger, the discharge line for the hot combustion exhaust gases, the combustion air conveyor device (e.g. a blower) which is also provided, the fuel conveyor device (e.g. a metering pump), the control unit for controlling the evaporator burner, etc. are not shown. These components are well-known and extensively described in the prior art.

The evaporator burner 1 comprises an evaporator body support 2 in which an absorbent evaporator body 5 is arranged. In the embodiment, the evaporator body support 2 comprises a substantially cup-shaped shape. The evaporator body 5 is accommodated in the cup-like depression of the evaporator body support 2 and can in particularly be fixedly held therein, e.g. by welding, soldering, clamping or using a suitable securing element. The design of the evaporator body 5 will be described more in detail in the following.

A fuel supply line 6 for supplying fuel to the evaporator body 5 is provided. The fuel supply line 6 opens into the evaporator body support 2 and is connected to a fuel conveying device (not shown) by which fuel can be conveyed through the fuel supply line 6 in a predetermined amount, as schematically depicted by arrow B. The fuel supply line 6 is fixedly connected to the evaporator body support 2, e.g. by welding or soldering.

The combustion space 4 is circumferentially bordered by a combustion chamber 7, which can e.g. be formed by a substantially cylindrical component of temperature resistant steel. The combustion chamber 7 is provided with a plurality of holes 7*a* via which combustion air can be supplied into the combustion space 4, as schematically depicted by arrows in FIG. 1.

The evaporator burner is formed such that in operation liquid fuel can be supplied to the evaporator body 5 via the fuel supply line 6. In the evaporator body 5, on the one hand, distribution of the fuel over the entire width of the evaporator body 5 takes place due to the multitude of cavities and, on the other hand, evaporation of the fuel takes place at the side facing the combustion space 4. In the depicted embodiment, the evaporator body 5 comprises a substantially circular cross-sectional shape in the center of which the main axis Z extends. The evaporator body 5 can however also have other cross-sectional shapes.

The evaporator body 5 comprises a construction with plural layers which is zoned into a first region B1 for distributing the liquid fuel and a second region B2 having a structure differing from the structure in the first region B1 for evaporating the liquid fuel. The first region B1 is arranged facing the fuel supply line 6 and the second region B2 is arranged facing the combustion space 4.

In the depicted embodiment, both the first region B1 and the second region B2 each comprise a plural-layer construction with a plurality of layers. Although schematically three layers are depicted in the first region B1 and schematically five layers are depicted in the second region B2 in the schematic illustration of FIG. 2, the two regions B1, B2 can each comprise more layers or fewer layers. For instance, it is also possible that the first region B1 and/or the second region B2 comprise only one layer. Although the layers in both regions B1, B2 are depicted as being equally thick in each case, the layers in the first region B1 can also have different thicknesses and the layers in the second region B2 can also have different thicknesses. Further, it is also possible that at least one further region is provided in addition to the two regions B1 and B2.

In the depicted embodiment, the layers 8 in the first region B1 are each formed by metal woven fabric of interwoven metal wires. In the embodiment, the layers 9 in the second region B2 can also be formed by metal woven fabric of interwoven metal wires or can also e.g. be formed by a metal non-woven fabric (metal fleece). The layers 8 in the first region B1 can be interconnected, e.g. by sintering or welding. Similarly, the layers 9 in the second region B2 can be interconnected, e.g. by sintering or welding. Further, the layers 8 of the first region B1 can be connected to the layers 9 of the second region B2, e.g. by sintering or welding.

The metal wires in the distinct layers 8 and 9, respectively, are made from a high-temperature resistant stainless steel. In the distinct layers 8 (and 9 in the case that also the layers 9 are formed by a metal woven fabric), the metal wires comprise a uniform wire diameter d, i.e. all the metal wires in the respective layer comprise the same wire diameter d and the distinct metal wires have a constant wire diameter over their length. The metal wires comprise a wire diameter d between 25 μm and 0.9 mm. Preferably, the metal wires in the first region B1 comprise a wire diameter d between 100 μm and 0.9 mm and the metal wires in the second region comprise a wire diameter d between 25 μm and 200 μm, preferably between 50 μm and 150 μm. The respective layers 8 or 9 of metal woven fabric can have changing orientations, e.g. a first layer can have a predetermined orientation of the warp threads and in a subsequent layer the warp threads can be arranged rotated by a predetermined angle with regard to the first layer, and so on. In this way, fuel distribution and fuel evaporation can be selectively influenced.

Figure 3:
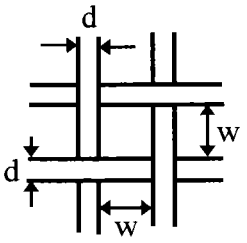
FIG. 3 is a schematic sketch for explaining the wire diameter and the mesh width in a metal woven fabric.

The metal woven fabric of which the respective layers 8 or 9, which are made of metal woven fabric, are formed is in each case tightly woven such that a relation w/d of the respective mesh width w to the respective wire diameter d fulfills the relation w/d≤1. The mesh width w is defined by the free distance between two neighboring weft threads or between two neighboring warp threads, respectively, as can be seen in the schematic illustration in FIG. 3. In the depicted embodiment, the wire diameter of the weft threads is identical to the wire diameter of the warp threads and the mesh width in the direction of extension of the weft threads is identical to the mesh width in the direction of extension of the warp threads. Also in the case of different mesh widths in these two directions (which can occur depending on the type of weaving pattern), preferably w/d≤1 holds for both directions.

As was already described, the layers 9 in the second region B2 or in an additional third region can e.g. also be formed by one or more layers of metal non-woven fabric (metal fleece). In a metal non-woven fabric, pressed and—as the case may be—sintered metal fibers are present which are arranged in an unordered (random) orientation with regard to each other. The distinct metal fibers comprise different lengths and different thicknesses or cross-sectional shapes. Preferably, the metal non-woven fabric can be formed as a thus-called short fiber non-woven fabric (short fiber fleece) having a mean fiber length shorter than 3 mm, preferably shorter than 2 mm, in particular shorter than 1.5 mm.

In the case of a combination of layers formed of metal woven fabric and at least one layer of metal non-woven fabric, the layer of metal non-woven fabric can e.g. be arranged at a side facing away from the fuel supply line 6 (i.e. at a side facing the combustion space) of the layers 8, 9 of metal woven fabric. Alternatively, it is also possible to arrange the at least one layer of metal non-woven fabric between the layers of metal woven fabric 8, 9 such that at least one layer of metal woven fabric is provided at a side facing away from the fuel supply line 6 (i.e. at a side facing the combustion space) of the metal non-woven fabric. In the latter case, the layer of metal woven fabric arranged at the side of the combustion space provides thermal protection and mechanical stability for the at least one layer of metal non-woven fabric and the entire evaporator body 5, respectively.

In a realization with at least two different layers of metal woven fabric and at least one layer of metal non-woven fabric, preferably at least one layer of metal woven fabric can be arranged immediately adjacent to the metal non-woven fabric and preferably fixedly connected to the latter. Preferably, the layer of metal woven fabric adjacent to the metal non-woven fabric can have a larger wire diameter and/or a larger mesh width as compared to layers of metal woven fabric which are arranged closer to the fuel supply line 6.

Although with regard to the embodiment a construction was described which is zoned into a first region B1 for fuel distribution and a second region B2 for fuel evaporation, such a construction is not mandatory and an evaporator body 5 can also be provided which does not comprise such a zoning.

The invention claimed is:

1. A vehicle heating device, having:

an evaporator burner and a heat exchanger through which hot exhaust gases are routed and in which at least a part of generated heat is transferred to a medium to be heated, the evaporator burner comprising an evaporator arrangement having, an evaporator body support into which a fuel supply line for supplying a liquid fuel opens, and an evaporator body for distributing and evaporating the liquid fuel, wherein the evaporator body comprises at least one layer of a metal woven fabric of interwoven metal wires, wherein the evaporator body comprises a construction with plural layers with at least one layer of a metal non-woven fabric, and wherein the at least one layer of the metal non-woven fabric is arranged at a side of the at least one layer of metal woven fabric which faces away from the fuel supply line.

2. A vehicle heating device according to claim 1, wherein the metal wires comprise stainless steel.

3. A vehicle heating device according to claim 1, wherein the metal wires in the at least one layer comprise a constant wire diameter (d).

4. A vehicle heating device according to claim 1, wherein the metal wires comprise a wire diameter (d) between 25 μm and 0.9 mm.

5. A vehicle heating device according to claim 1, wherein the metal wires in the metal woven fabric are tightly interwoven with a relation w/d of a mesh width w to a wire diameter d fulfilling: w/d≤1.

6. A vehicle heating device according to claim 1, wherein the evaporator body comprises a construction with a plurality of layers of metal woven fabric of interwoven metal wires.

7. A vehicle heating device according to claim 6, wherein at least one first layer of metal woven fabric and a second layer of metal woven fabric are provided, the second layer being arranged at a side of the first layer which faces away from the fuel supply line, and that the second layer is formed from metal wires having a smaller wire diameter (d) than the metal wires in the first layer.

8. A vehicle heating device according to claim 1, wherein the evaporator body comprises a first region for distributing the liquid fuel and a second region for evaporating the liquid fuel, the second region having a structure differing from the structure in the first region.

9. A vehicle heating device according to claim 1, wherein the at least one first layer of metal woven fabric, at least one second layer of metal woven fabric, the second layer being arranged at a side of the first layer facing away from the fuel supply line, and at least one layer of a metal non-woven fabric are provided and that the at least one second layer is formed from metal wires having another wire diameter (d) and/or another mesh width (w) than the metal wires in the at least one first layer.

10. A vehicle heating device according to claim 9, wherein the layer of metal non-woven fabric is arranged at a side of the at least one second layer of metal woven fabric facing away from the fuel supply line.

11. A vehicle heating device according to claim 9, wherein the layer of metal non-woven fabric is arranged between the at least one first layer of metal woven fabric and the at least one second layer of metal woven fabric.

12. A vehicle heating device according to claim 9, wherein the at least one second layer of metal woven fabric is formed from metal wires comprising a larger wire diameter (d) and/or a larger mesh width (w) than the metal wires in the at least one first layer.

13. A vehicle heating device according to claim 1, wherein at least one layer of a metal non-woven fabric is provided which comprises a sintered metal non-woven fabric having a mean fiber length of the metal fibers shorter than 3 mm.

14. A vehicle heating device according to claim 1, wherein at least one layer of a metal non-woven fabric is provided which comprises a sintered metal non-woven fabric having a mean fiber length of the metal fibers shorter than 2 mm.

15. The vehicle heating device according to claim 1, wherein the heat exchanger is adapted such that the heat is transferred to cooling liquid in a cooling liquid circuit.

* * * * *